US005613716A

United States Patent [19]

Cafferty

[11] Patent Number: 5,613,716

[45] Date of Patent: Mar. 25, 1997

[54] ELECTRONIC VEHICLE DOOR UNLATCH CONTROL

[75] Inventor: Daniel F. Cafferty, Dearborn, Mich.

[73] Assignee: General Motors Corporation, Detroit, Mich.

[21] Appl. No.: 591,069

[22] Filed: Jan. 25, 1996

[51] Int. Cl.[6] ..... E05C 3/26

[52] U.S. Cl. ..... 292/216; 292/201

[58] Field of Search ..... 292/216, DIG. 3, 292/DIG. 23, DIG. 26, 201

[56] References Cited

U.S. PATENT DOCUMENTS

| | | | |
|---|---|---|---|
| 3,695,662 | 10/1972 | Ploughman | 292/216 |
| 3,857,001 | 12/1974 | Quantz | 200/61.64 |
| 4,219,227 | 8/1980 | Grabner et al. | 292/216 |
| 4,298,223 | 11/1981 | Raffelsiefer et al. | 292/216 |
| 4,518,180 | 5/1985 | Kleefeldt et al. | 292/201 |
| 4,518,182 | 5/1985 | Cousin et al. | 292/201 |
| 4,569,544 | 2/1986 | Escaravage | 292/216 |
| 4,624,491 | 11/1986 | Vincent | 292/201 |
| 4,664,430 | 5/1987 | Bernard | 292/201 |
| 4,762,348 | 8/1988 | Matsumoto | 292/201 |
| 4,763,936 | 8/1988 | Rogakos et al. | 292/201 |
| 4,802,350 | 2/1989 | Periou | 70/264 |
| 4,858,971 | 8/1989 | Haag et al. | 292/201 |
| 5,020,838 | 6/1991 | Fukumoto | 292/201 |
| 5,236,234 | 8/1993 | Norman | 292/201 |
| 5,516,164 | 5/1996 | Kobayashi | 292/201 |

*Primary Examiner*—Steven N. Meyers
*Assistant Examiner*—Donald J. Lecher
*Attorney, Agent, or Firm*—Robert M. Sigler

[57] ABSTRACT

An electronic vehicle door unlatch control reduces unwanted noise and actuator stress by varying unlatch actuator activation duration to provide the minimum duration required for door opening. A reversible actuator moves a detent between a fork bolt releasing position and a fork bolt retaining position; and an unlatch switch is activated by the fork bolt to signal whether the door is open or closed. A door opening signal activates the actuator to move the detent to the fork bolt releasing position and deactivate the actuator when the unlatch switch indicates the door is open or at the end of a first predetermined time period, whichever occurs first. The actuator is then activated in reverse to return the detent essentially to the fork bolt retaining position when the unlatch switch indicates the door is open, when the door opening signal is no longer received, or at the end of a second predetermined time period longer than the first predetermined time period, whichever occurs first. Usually, the detent will be activated to its fork bolt releasing position, the striker will escape the fork bolt and the detent will be returned to its fork bolt retaining position in a time of such short duration that actuator noise and stress will be minimized. Even if the door is frozen shut, however, the initial activation of the detent to its fork bolt releasing position will be limited in duration to the first predetermined time period; and the detent will stay in that position, with the actuator inactivated and therefore silent and unstressed, until the door opens, the operator stops trying to open it or the second predetermined time period times out.

1 Claim, 3 Drawing Sheets

ELECTRONIC VEHICLE DOOR UNLATCH CONTROL

BACKGROUND OF THE INVENTION

The field of this invention is the control of vehicle door latches. The invention particularly relates to an electronic control which provides a minimum of actuation noise that could be annoying to a vehicle operator or passenger.

Vehicle door latch systems of the prior art typically comprise a rotatable fork bolt which, as a door is manually closed, is engaged in a door open position by a striker and rotated by the striker to a door closed position in which the striker is captured. A detent holds the fork bolt in the closed position against the door opening force of the compressed door weather seals. To open the door, the detent is disengaged from the fork bolt; and the seal force pushes the door open, with the striker rotating the fork bolt into the door open position as it escapes. A handle is connected by a mechanical linkage to the detent so that an operator can initiate door unlatching; and a lock mechanism physically prevents activation when locked.

Electronic unlatch systems of the prior art use the same basic unlatch mechanism but provide an electric actuator, with unlatching initiated by activation of a switch rather than by a mechanical linkage. For example, U.S. Pat. No. 4,858,971 to Haag et al shows an electronic vehicle door lock/unlatch control in which an electric motor provides activation of a vehicle door unlatch mechanism when it is connected in direct circuit with a DC power source by closure of an operator activated switch. Locking/unlocking is provided by a FET connected in series with the motor and operator activated switch and a flip-flop which can be activated to an unlock state to permit current flow through the FET and a lock state to prevent such current flow. The operator activated switch is mounted on a door handle so that the operator can activate the switch and pull the door fully open when it is unlatched. However, as shown, the motor will be activated as long as the switch is closed; and activated motors are subjected to stress and make noise which can be annoying to the operator. Some systems of more recent design provide a shorter actuator activation period, regardless of how long the activation switch is pressed, by initiating activation in response to switch activation but controlling activation duration by an timing circuit.

However, vehicles operated in the winter in cold climates are occasionally subject to doors being frozen shut—a situation in which moisture on the outside of the door weather seals freezes and holds the door in the closed position to prevent rotation of the fork bolt when the latter is released by the detent. Such a door must be physically pulled open from its primary latch position; and the detent must be held in a fork bolt releasing position for up to several seconds to permit this to happen. This is easily done in the Haag et al system described above by the operator continuing to activate the switch, but the motor activation noise and actuator stress will continue throughout the activation. This is much less easily done in a system using a timed activation period, since such periods are typically very short. On the other hand, lengthening the activation period to provide easier frozen door opening results in greater noise and actuator stress in the vast majority of cases where the door is not frozen shut.

SUMMARY OF THE INVENTION

This invention is an electronic vehicle door unlatch control which reduces unwanted noise and actuator stress by varying unlatch actuator activation duration to provide the minimum duration required for door opening. This is accomplished by providing a reversible actuator which is activatable in a first direction to move the detent to its fork bolt releasing position with the detent remaining in the fork bolt releasing position when the actuator is deactivated, and further activatable in a second direction to return the detent toward its fork bolt retaining position. An unlatch switch is activated by the fork bolt to signal whether the door is open or closed. Means are provided for generating a door opening signal; and opening means are responsive to the door opening signal to activate the actuator to move the detent to the fork bolt releasing position and to deactivate the actuator when the unlatch switch indicates the door is open or at the end of a first predetermined time period, whichever occurs first. Finally, reset means are provided for activating the actuator to return the detent to the fork bolt retaining position, following deactivation of the actuator by the opening means, when the unlatch switch indicates the door is open, when the release means no longer generates the door opening signal, or at the end of a second predetermined time period longer than the first predetermined time period, whichever occurs first.

In typical operation, the detent will be activated to its fork bolt releasing position, the striker will clear the fork bolt and the detent will be returned to its fork bolt retaining position in a time of such short duration that actuator noise and stress will be minimized. Even if the door is frozen shut, however, the initial activation of the detent to its fork bolt releasing position will last a maximum of the first predetermined time period; and the detent will stay in that position, with the actuator inactivated and therefore silent, until the end of the second predetermined time period, if necessary. If the vehicle operator succeeds in opening the frozen door, the noise produced by the actuator in back-driving the detent to its fork bolt retaining position will be covered by the noise of the opening door; and if he does not, the noise will signal the vehicle operator that the door is once again latched.

DESCRIPTION OF A PREFERRED EMBODIMENT

Figure 1:
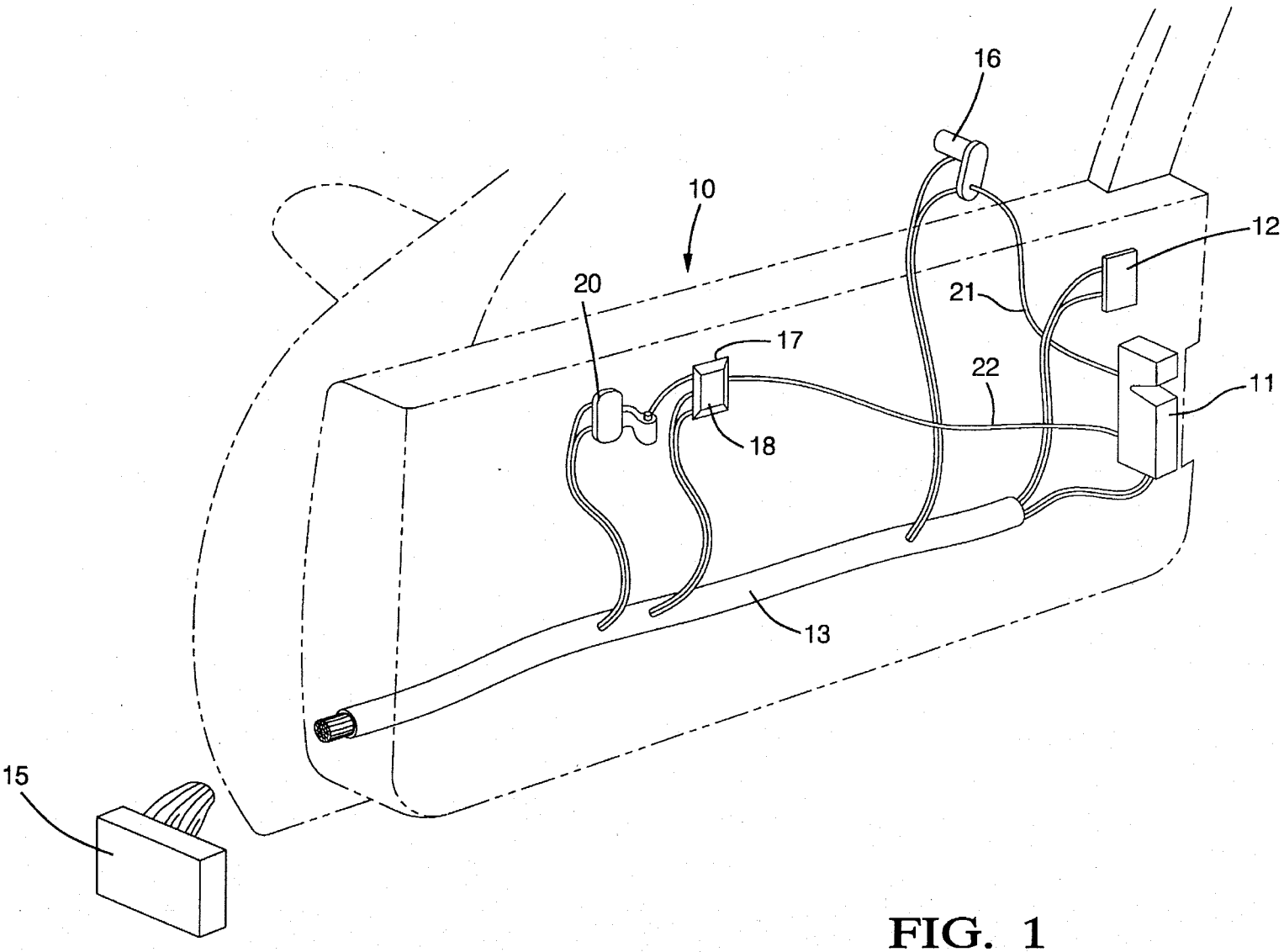
FIG. 1 shows an electronic vehicle door unlatching system with a control according to the invention.

Referring to FIG. 1, a door 10 of a motor vehicle includes a latch assembly 11 including a fork bolt/striker-based latch mechanism of a known type which is activated by means of an electric actuator, as will be described more fully at a later point in this description with reference to FIGS. 2–4. An exterior door release 12 comprises a release switch which is connected through a vehicle wiring harness 13 in circuit with a vehicle power supply, a control module 15 and the actuator of latch assembly 11 so as to cause unlatching in assembly 11 to permit opening of door 10 in response to activation of door release 12 or of a similar interior door release 20 which comprises a similar release switch. An exterior electronic locking module 16 and a similar interior locking module 17 may be provided for providing door locking and unlocking signals to module 15, which may be co-packaged with latch mechanism 11 if desired. Manual unlatch cables 21 and/or 22 may be provided from locking modules 16 and/or 17 as shown or from any other suitable location in an emergency unlatching mechanism.

Figure 2:
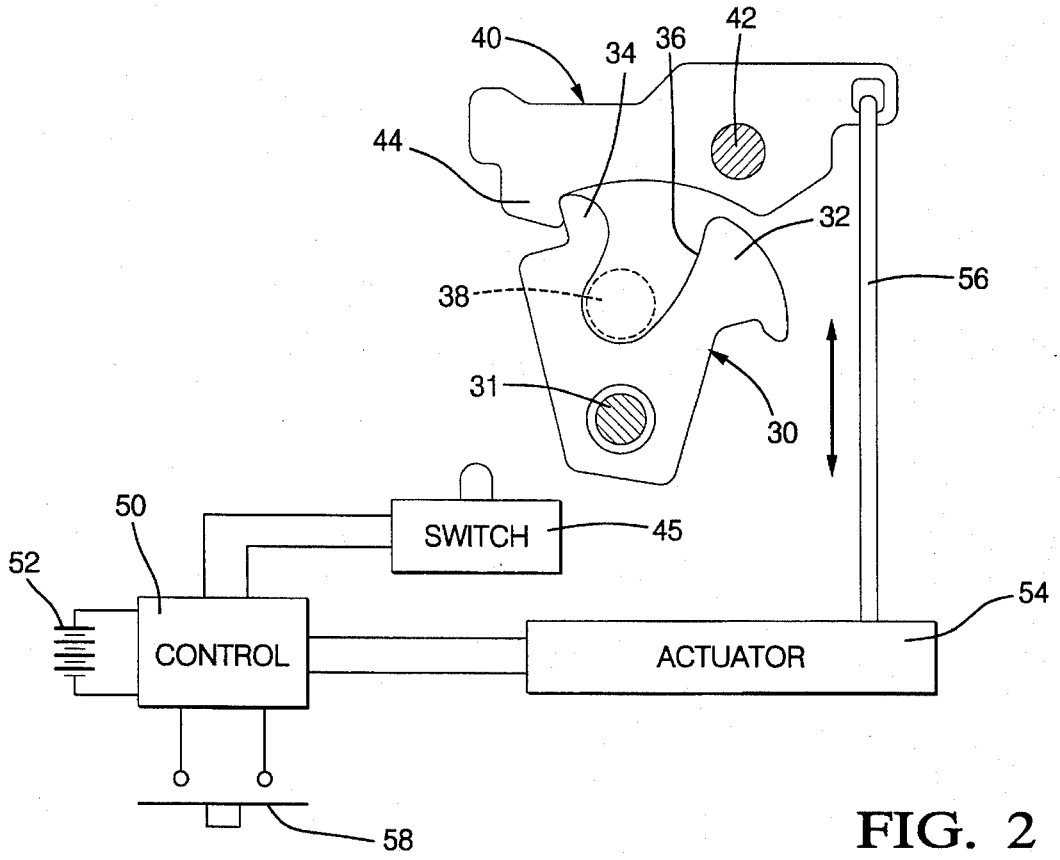
FIG. 2 is a schematic and block diagram of selected parts of the system of FIG. 1 with the latch in a door closed position.

FIG. 2 shows the most relevant parts of the door unlatching system with the latch in its fully latched state, which is generally known as primary latch. The latch mechanism itself comprises, most basically, a fork bolt 30 mounted rotatably by means of a pivot 31 on a latch housing, not shown. Fork bolt 30 comprises a latch hook 32 and primary hook 34 which define between them a throat 36. The latch housing and fork bolt 30 are attached to one of the vehicle body and door, most usually the latter. A striker 38 projects from the other of the vehicle body and door, most usually the former, and is retained within throat 36 of fork bolt 30 and another throat, in the latch housing, the latch housing throat being oriented substantially perpendicularly to throat 36 in the door closed position shown. A detent 40 is rotatably mounted by means of a pivot 42 on the latch housing and has a detent tooth 44 which engages primary hook 34 in the door closed position shown to prevent counterclockwise rotation of fork bolt 30 and thus maintain door 10 closed in primary latch.

An unlatch switch 45, positioned adjacent fork bolt 30, provides a door closed signal to a control 50, which is powered by a vehicle power supply 52. Control 50 may comprise a digital computer having a stored internal control program with input apparatus for receiving switch and other input signals and output apparatus for controlling one or more actuators. Unlatch switch 45 is shown, for convenience, in a package with a push button actuator; but it may take any suitable form such as, for example, a slider actuated switch with a toothed slider rack engaged by a toothed gear rotating with fork bolt 30. An actuator 54 may comprise, for example, a reversible DC motor with output reducing gears and a rotary to linear motion converter with an output link 56 connected to detent 40. A release switch 58, which symbolically represents the release switches of exterior door release 12 and/or interior door release 20, may be activated to provide a release signal to control 50 while closed. One or more door locking switches, not shown, may further provide door locking or unlocking signals to control 50 from modules 16 and/or 17.

Figure 3:
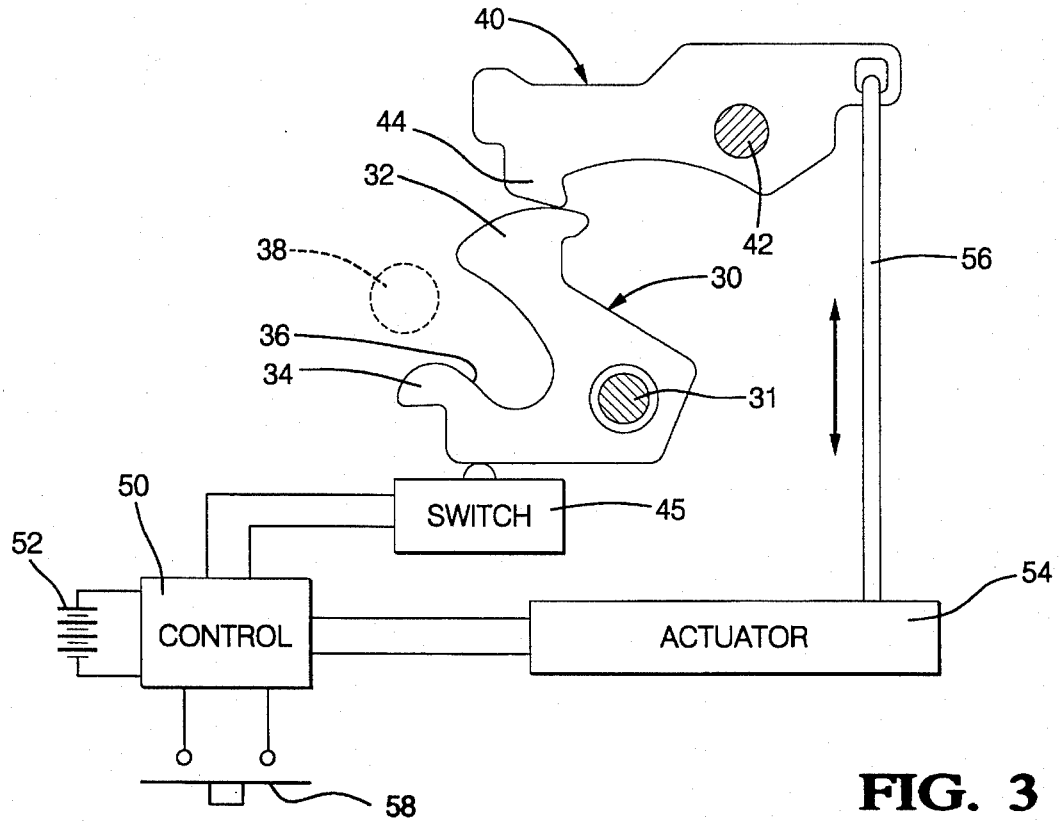
FIG. 3 is a schematic and block diagram of selected parts of the system of FIG. 1 with the latch in a door open position.

FIG. 3 shows the same parts of the door unlatching system with the fork bolt 30, striker 38 and detent 40 in the unlatched state, with door 10 open. Fork bolt 30 is rotated almost 90° from the position shown in FIG. 2 so that throat 36 aligns with the similar throat in the latch housing and allows striker 38 to escape as door 10 is pushed open by the force of the compressed door weather seals, not shown. Unlatch switch 45 is acted upon by fork bolt 30 in the door open position of FIG. 3 to provide a door open signal to control 50.

It should be noted that there is another position, between primary latch and full open, known as secondary latch, in which fork bolt 30 is partially rotated between the positions shown in FIGS. 2 and 3 and detent tooth 44 engages latch hook 32. The apparatus of this invention is intended to provide full unlatching of door 10; and unlatch switch 45 is thus designed to change state only when fork bolt 30 has rotated sufficiently that the door is fully out of both primary and secondary latch. Activation of release switch 58 will open the door from either primary or secondary latch in the same manner; and it is not deemed necessary to show in a drawing or otherwise more fully describe the secondary latch position. In this description and the following claims, secondary latch is considered equivalent to primary latch; and the phrases "fork bolt retaining position," used with reference to detent 40, and "door closed position," used with reference to fork bolt 30, are meant to encompass either primary or secondary latch.

It should also be noted that, although the invention relates only to door unlatching, a practical apparatus will clearly be capable of latching when door 10 is manually closed. The rotation of fork bolt 30 from its door open position to its door closed position requires latch hook 32 and primary hook 34 to pass detent tooth 44 after detent 40 is returned toward its fork bolt retaining position. In order for this passing to occur with the apparatus as shown and described herein, detent tooth 44 must move upwards slightly but should be returned to the position shown in FIG. 2 to retain fork bolt 30 in its door closed position. For this purpose, a spring loaded, one way, lost motion connection may be included somewhere in the linkage between actuator 54 and detent tooth 44. This connection allows a limited movement of detent 40 from the position shown in FIG. 2 in the passing of latch hook 32 or primary hook 34 but includes a return mechanism, such as a spring, to return detent 40 to the position shown in FIG. 2. However, this return mechanism is of limited scope and will not, by itself, return detent 40 to its fork bolt retaining position from the fork bolt releasing position to which it is driven by actuator 54 in the initiation of door unlatching.

In operation, the door unlatching system begins in the door closed position (either in primary latch, as shown in FIG. 2, or in secondary latch, as explained above), with unlatch switch 45 providing a door closed signal to control 50. Detent 40, rotatably mounted on door 10, retains fork bolt 30, also rotatably mounted on door 10, to hold striker 38, which projects from the vehicle body, so that door 10 is held in a closed position against the force of the compressed door weather seals. Closure of release switch 58 provides a release signal to control 50, which initiates the activation of actuator 54 under control of the stored internal control program to release fork bolt 30 for counter-clockwise rotation by striker 38 as the force of the compressed weather seals pushes door 10 out of primary latch and past secondary latch to its open position, whereupon unlatch switch 45 provides a door open signal to control 50. When release switch 58 is opened, the release signal is no longer provided.

Figure 4:
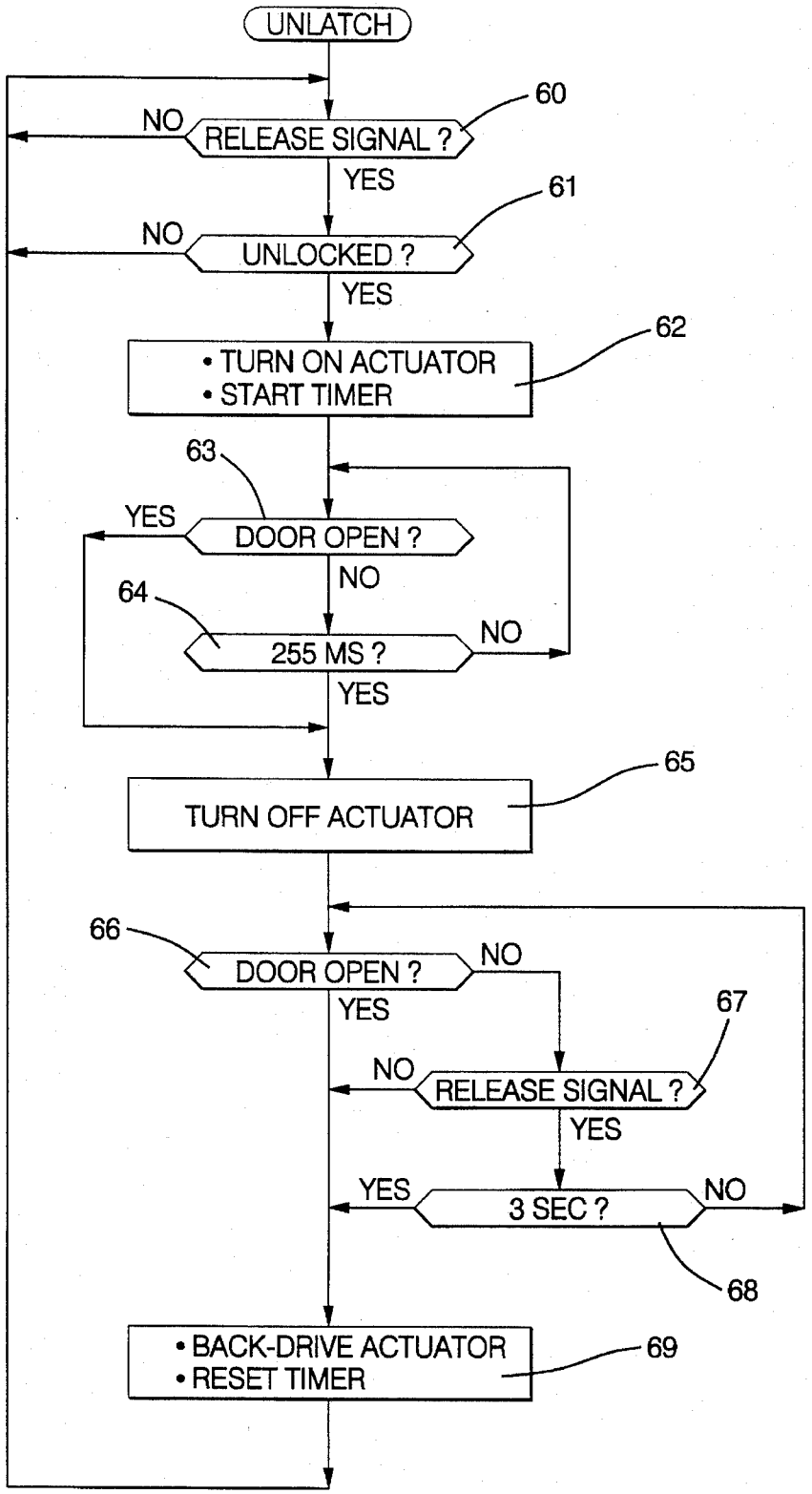
FIG. 4 is a computer flow chart illustrating the operation of the preferred embodiment of a control in the vehicle door unlatching system of FIGS. 1–3.

FIG. 4 shows a flow chart for an internal control program UNLATCH which can be used by control 50 in the system shown in FIGS. 1–3. The program repeatedly loops around step 60, in which it checks the status of release switch 58, until it detects a valid release signal. When such a signal is detected, the lock state is queried at step 61. The lock state can be as simple as a single bit in a control byte which is set or reset by lock and unlock signals from modules 16 and 17. If the door is locked, the program loops back to step 60. If it is unlocked, the actuator is tamed on in a first direction at step 62 to begin rotation of detent 40 clockwise out of the fork bolt retaining position shown in FIG. 3. An activation timer is also started at step 62.

The signal from unlatch switch 45 is checked at step 63. If it indicates that door 10 is open, the program skips step 64 and turns actuator 54 off at step 65. If door 10 is still closed at step 63, the program checks the activation timer at step 64. If the actuator has not been activated for a first predetermined time period, such as 255 milliseconds, the program loops back to step 63. If the actuator has been activated for the first predetermined time period, the program proceeds to step 65. Steps 63–65 thus comprise a loop which determines how long actuator 54 will be activated to move detent 40 into its fork bolt releasing position. Step 63 provides that this time period will be no longer than that required for the door to open; and step 64 guarantees that, in any case, it will be no longer than the first predetermined time period. In normal conditions, the period of activation will be considerably shorter than the 255 milliseconds of the first predetermined time period. When the activation of actuator 54 is stopped at step 65, detent 40 is left in its fork bolt releasing position, where it stays as the program proceeds.

At step 66, the program again checks the signal from unlatch switch 45. If door 10 is open, the program proceeds at step 69 to immediately activate actuator 54 in a second direction to back-drive detent 40 counter-clockwise to its fork bolt retaining position. The program further resets the activation timer at step 69 before looping back to step 60. If door 10 is not open at step 66, the program checks for a valid release signal in step 67. If there is no valid release signal, the operator is no longer activating release switch 58. Thus, the program proceeds to step 69. If there is a valid release signal at step 67, however, release switch 58 is still being activated. Thus, the program next checks the activation timer in step 68. If the time is less than a second predetermined time period, longer than the first, the program loops back to step 66. If not, however, the program proceeds to step 69. The second predetermined time period may be 3 seconds to permit frozen door opening.

Steps 66–69 thus provide another loop which determines how long actuator 54 will remain deactivated before it is activated in the second direction to return detent 40 to its fork bolt retaining position. In any event, it will be so activated as soon as door 10 opens; and this would typically be immediately, since actuator 54 is normally mined off at step 65 by a detection of an open door at step 63. Thus, in normal operation, the activation of actuator 54 in both directions will be of short duration and essentially continuous. If the door is frozen closed, however, steps 67 and 68 will provide additional time, up to a total of three seconds since initial activation, for the vehicle operator to attempt to pull the door out of primary latch, the operator's desire to do so being indicated by continued activation of release switch 58. As soon as door 10 opens, the operator releases switch 58 or the second predetermined time period elapses, whichever occurs first, actuator 54 is activated in the second direction to return detent 40 to its fork bolt retaining position. It should be noted that, if door 10 is open when detent 40 returns to its fork bolt retaining position, fork bolt 30 will be in its door open position and will not be retained by detent 40 until door 10 is manually closed. If door 10 is not open, however, when detent 40 returns to its fork bolt retaining position, fork bolt 30 will immediately be retained again in primary latch.

I claim:

1. A control for a vehicle door unlatch mechanism, the vehicle door unlatch mechanism comprising a rotatable fork bolt and a detent on one of a vehicle body and a vehicle door and a striker on the other of the vehicle body and the vehicle door, the fork bolt having a door closed position in which the striker is retained therein against an opening force generated between the door and body and a door open position in which the striker is released therefrom to allow the door to be opened by the opening force, the control comprising, in combination:

a reversible actuator activatable in a first direction to move the detent from a fork bolt retaining position to a fork bolt releasing position, the detent remaining in the fork bolt releasing position when the actuator is deactivated, and further activatable in a second direction to return the detent from the fork bolt releasing position toward the fork bolt retaining position;

an unlatch switch activated by the vehicle fork bolt to provide a first signal when the fork bolt is in the door closed position and to provide a second signal when the fork bolt is in the door open position;

release means for generating a door opening signal;

opening means responsive to the door opening signal to activate the actuator in the first direction and deactivate it when the unlatch switch provides the second signal or at the end of a first predetermined time period, whichever occurs first; and reset means for activating the actuator in the second direction, following deactivation of the actuator by the opening means, when the unlatch switch provides the second signal, when the release means no longer generates the door opening signal, or at the end of a second predetermined time period longer than the first predetermined time period, whichever occurs first.

* * * * *